US006896252B2

(12) United States Patent
Jensen

(10) Patent No.: US 6,896,252 B2
(45) **Date of Patent: *May 24, 2005**

(54) DEVICE FOR LIFTING A POROUS SHEET FROM A STACK OF SUCH SHEETS

(75) Inventor: David William Jensen, Balmain (AU)

(73) Assignee: Silverbrook Research PTY LTD, Balmain (AU)

( * ) Notice: Subject to any disclaimer, the term of this patent is extended or adjusted under 35 U.S.C. 154(b) by 120 days.

This patent is subject to a terminal disclaimer.

(21) Appl. No.: 10/693,873

(22) Filed: Oct. 28, 2003

(65) Prior Publication Data

US 2004/0089995 A1 May 13, 2004

Related U.S. Application Data

(63) Continuation of application No. 10/309,226, filed on Dec. 4, 2002, now Pat. No. 6,648,321, which is a continuation of application No. 10/052,424, filed on Jan. 23, 2002, now Pat. No. 6,568,670.

(30) Foreign Application Priority Data

Feb. 19, 2001 (AU) ..... PR3153

(51) Int. Cl.[7] ..... B65H 3/14

(52) U.S. Cl. ..... 271/98; 271/90; 271/93; 271/97; 271/94; 271/108

(58) Field of Search ..... 271/98, 97, 90, 271/93, 94, 108

(56) References Cited

U.S. PATENT DOCUMENTS 3,130,602 A * 4/1964 Nigrelli et al. ..... 74/593
3,558,126 A * 1/1971 Jiruse ..... 271/98
4,089,518 A * 5/1978 Vollrath ..... 271/167
4,496,143 A 1/1985 Weyer
4,579,330 A * 4/1986 Lehmann ..... 271/11
4,669,716 A * 6/1987 VanderSyde et al. ..... 271/98
4,887,805 A 12/1989 Herbert et al.
5,058,876 A * 10/1991 Grossmann ..... 271/98
5,092,576 A * 3/1992 Takahashi et al. ..... 271/3.11
5,098,077 A * 3/1992 Russel ..... 271/3.13
5,110,110 A * 5/1992 Wirz et al. ..... 271/98
5,184,813 A * 2/1993 Schwitzky et al. ..... 271/98
5,836,582 A * 11/1998 Ogawa et al. ..... 271/12
5,876,031 A * 3/1999 Ohkoda et al. ..... 271/14
6,398,206 B1 * 6/2002 Yang et al. ..... 271/90
6,398,207 B1 * 6/2002 Taylor et al. ..... 271/106
6,398,208 B1 * 6/2002 Yang et al. ..... 271/107
6,502,815 B1 * 1/2003 Baureis et al. ..... 271/11

FOREIGN PATENT DOCUMENTS

DE 4 227 814 2/1993
EP 0 741 098 11/1996

OTHER PUBLICATIONS

Derwent 92 215190/26 **, Sep. 30, 1991, Mosc Printing Inst.

* cited by examiner

*Primary Examiner*—Donald P Walsh
*Assistant Examiner*—Matthew J Kohner

(57) ABSTRACT

A device for lifting a porous sheet from a stack of such sheets includes a gas stream supply mechanism that is configured to generate a gas stream and is positioned so that, in use, the gas stream impinges on a first sheet of the stack. The gas stream supply mechanism is configured so that the gas stream penetrates the first sheet to generate a cushion of gas between the first sheet and a second sheet, thereby lifting the first sheet from the second sheet. A capturing mechanism captures the first sheet.

12 Claims, 5 Drawing Sheets

DEVICE FOR LIFTING A POROUS SHEET FROM A STACK OF SUCH SHEETS

This is a Continuation Application of Ser. No. 10/309,226 filed on Dec. 4, 2002, now U.S. Pat. No. 6,648,321, which is a continuation of Ser. No. 10/052,424 filed Jan. 23, 2002 now U.S. Pat. No. 6,568, 670.

FIELD OF THE INVENTION

This invention relates to a sheet-handling device. More particularly, this invention relates to a device for lifting a porous sheet from a stack of such sheets.

BACKGROUND TO THE INVENTION

The applicant has developed various printheads which provide high speed, photographic quality printing. The printheads comprise ink jet nozzles arranged in a close packed array. To provide the photographic quality printing, the nozzles are so arranged so as to provide a resolution of up to 1600 dots per inch (dpi).

The ink jet nozzles are formed using microelectromechanical systems (MEMS) technology. The use of MEMS technology results in very high speed printing capabilities where pages can be printed at a rate of up to 2 pages per second (for double-sided printing). To facilitate such high speed printing, it is important, firstly, that the paper or print media fed to the printing station of the printer is accurately aligned and capable of the required feed rate with as little likelihood as possible of paper jams or the like occurring. Secondly, the paper must be able to be fed to the printing station at a rate sufficient to use the high speed printing capabilities of the printing station to its fullest extent.

SUMMARY OF THE INVENTION

According to a first aspect of the invention there is provided a device for lifting a porous sheet from a stack of such sheets, the device comprising a gas stream supply mechanism that is configured to generate a gas stream and is positioned so that, in use, the gas stream impinges on a first sheet of the stack, the gas stream supply mechanism being configured so that the gas stream penetrates the first sheet to generate a cushion of gas between the first sheet and a second sheet, thereby lifting the first sheet from the second sheet; and a capturing mechanism for capturing the first sheet.

The capturing mechanism may be displaceable between a pick-up position in which the first sheet is captured and a feed position in which the first sheet can be engaged by a feed mechanism. The device includes a displacement mechanism for displacing the capturing mechanism between the pick-up and feed positions.

The gas stream supply mechanism may include an air displacement device having an outlet conduit and at least one outlet nozzle connected to the outlet conduit. The, or each, outlet nozzle may be displaceable between a pick-up position proximate the first sheet of the stack and a feed position. The air displacement device may be configured to generate a flow of air from the, or each, outlet nozzle sufficient to penetrate the first sheet such that a cushion of air is generated between the first sheet and a second sheet to lift the first sheet from the second sheet.

The capturing mechanism may include an air extraction device having an inlet conduit, at least one inlet nozzle connected to the inlet conduit, the, or each, inlet nozzle defining a pick-up surface and being displaceable between the pick-up position proximate the first sheet of the stack and a feed position. The air extraction device may be configured to generate a flow of air into the, or each, inlet nozzle such that the first sheet is drawn against the pick-up surface.

The device may include a plurality of outlet nozzles that are positioned to span the first sheet, a plurality of inlet nozzles, also positioned to span the first sheet, an outlet manifold that interconnects the outlet conduit of the air displacement device and the outlet nozzles and an inlet manifold that interconnects the inlet conduit of the air extraction device and the inlet nozzles.

The inlet and outlet nozzles may be generally aligned and may be in alternating positions with respect to each other.

The air displacement mechanism may be an air pump and the air extraction device may be an evacuation pump. Both pumps may be connected to a shaft of a drive motor so that, when operated, the air pump serves to supply air to the outlet conduit and to draw air into the inlet conduit substantially simultaneously.

A flexible hose may interconnect each nozzle with its respective manifold, thereby facilitating displacement of the nozzles with respect to their respective manifolds.

The displacement mechanism may be a reciprocal drive mechanism for driving the inlet and outlet nozzles reciprocally between the pick-up position and the feed position.

The nozzles may be connected to an elongate carrier, which, in turn, is connected to the reciprocal drive mechanism so that the elongate carrier and thus the nozzles can be displaced reciprocally between the pick-up and feed positions.

The elongate carrier may be a bar and the drive mechanism may include a stepper motor connected to an axle that extends substantially parallel to the bar. A swing arm may be interposed between each end of the axle and a corresponding end of the bar so that reciprocal movement generated by the stepper motor can be transmitted to the bar and thus the nozzles.

Each nozzle may have a sheet-engaging member that, in respect of the inlet nozzles, defines the pick-up surfaces and, in respect of the outlet nozzles is such that as air is expelled from the outlet nozzles, a region of low pressure is generated intermediate the outlet nozzle and the first sheet, thereby facilitating lifting of the first sheet.

According to a second aspect of the invention, there is provided an apparatus for separating a sheet of print media from a stack of sheets, the sheets of the stack being porous and the apparatus including:

a sheet conveying means for conveying a topmost sheet of print media, which has been separated from the stack, to a printing station of a printer;

a separating means, associated with the sheet conveying means for separating the sheet of print media from the stack, the separating means including a fluid delivery means for blowing fluid on to a top surface of the stack for effecting separation of the topmost sheet of print media from the stack; and a capturing means, carried by the sheet conveying means, for capturing at least a part of said topmost sheet and for facilitating conveyance of said topmost sheet by the sheet conveying means to the printing station.

The sheet conveying means may comprise a picker assembly for picking the topmost sheet from the stack. The picker assembly may comprise an elongate element in the form of a bar or tube and a plurality of displacement assistance means for assisting in displacement of the topmost sheet from the stack, the displacement assistance means being arranged at spaced intervals along a length of the elongate element.

A further embodiment of the present invention provides a sheet separator apparatus for separating a sheet of print media from a stack of sheets, the sheets of the stack being porous and the sheet separator including:

a conveyor that conveys a topmost sheet of print media which has been separated from the stack to a printing station of a printer;

at least one fluid outlet providing a fluid flow through a top surface of the stack for effecting separation of the topmost sheet of print media from the stack; and a pick up device, carried by the conveyor, that captures at least a part of said topmost sheet and aids conveyance of said topmost sheet by the sheet conveyor to the printing station.

The elongate element may define a plurality of fluid ports and each displacement assistance means may comprise a footprint-defining portion surrounding one of the ports and depending from the elongate element. More particularly, each displacement assistance means may be in the form of a pad or disc which depends from the elongate element towards the stack, in use. Each pad may depend from a hollow stalk which is received in one of the fluid ports of the elongate element. The stalk may define a passage.

The fluid delivery means may comprise a plurality of fluid supply conduits, each conduit being in fluid communication with one of the fluid ports of the elongate element, only certain of the fluid ports having fluid supply conduits associated with them with a remainder of the fluid ports not being in fluid communication with the fluid supply conduits.

The fluid supply conduits may be connected to, and communicate with, a fluid supply manifold.

The capturing means may be a fluid suction arrangement, the capturing means comprising a plurality of fluid suction conduits, each fluid suction conduit being in fluid communication with one of the remainder of the fluid ports of the elongate element.

The fluid suction conduits may be connected to, and communicate with, a fluid extraction manifold.

The picker assembly is operable to lift the topmost sheet from the stack and to feed it to the printing station. A pair of pinch rollers may be arranged at an input to the printing station. In a preferred embodiment, the bar of the picker assembly is mounted on a pair of spaced swing arms and pivots relative to the swing arms. The swing arms, in turn, are fixedly mounted on an axle which is rotatably supported on the printer. Accordingly, to facilitate movement of the bar of the picker assembly, the fluid supply conduits and the fluid suction conduits may be in the form of flexible hoses.

The apparatus may comprise a fluid supply means for supplying a fluid to the fluid supply manifold for supply to the fluid supply conduits and a fluid extraction means for extracting fluid from the fluid extraction manifold to create a suction effect in the fluid suction conduits. The apparatus may further comprise a drive means for driving the fluid supply means and the fluid extraction means. The fluid supply means and the fluid extraction means may each be in the form of an air pump and extraction pump, respectively.

The drive means may be a drive motor. The air pump may be mounted on a first output shaft of the drive motor with the extraction pump being mounted on an opposed, second output shaft of the drive motor.

The apparatus may further comprise a control means for controlling supply of fluid to the fluid supply manifold and extraction of fluid from the fluid extraction manifold. The control means may comprise a valve arranged in each of the fluid supply manifold and the fluid extraction manifold. Preferably, each valve is electromagnetically operated. More particularly, each valve may be in the form of a solenoid valve arranged in an inlet opening of the fluid supply manifold and an outlet opening of the fluid suction manifold.

BRIEF DESCRIPTION OF THE DRAWINGS

The invention is now described by way of example with reference to the accompanying drawings in which.

DETAILED DESCRIPTION OF THE DRAWINGS

Figure 1:
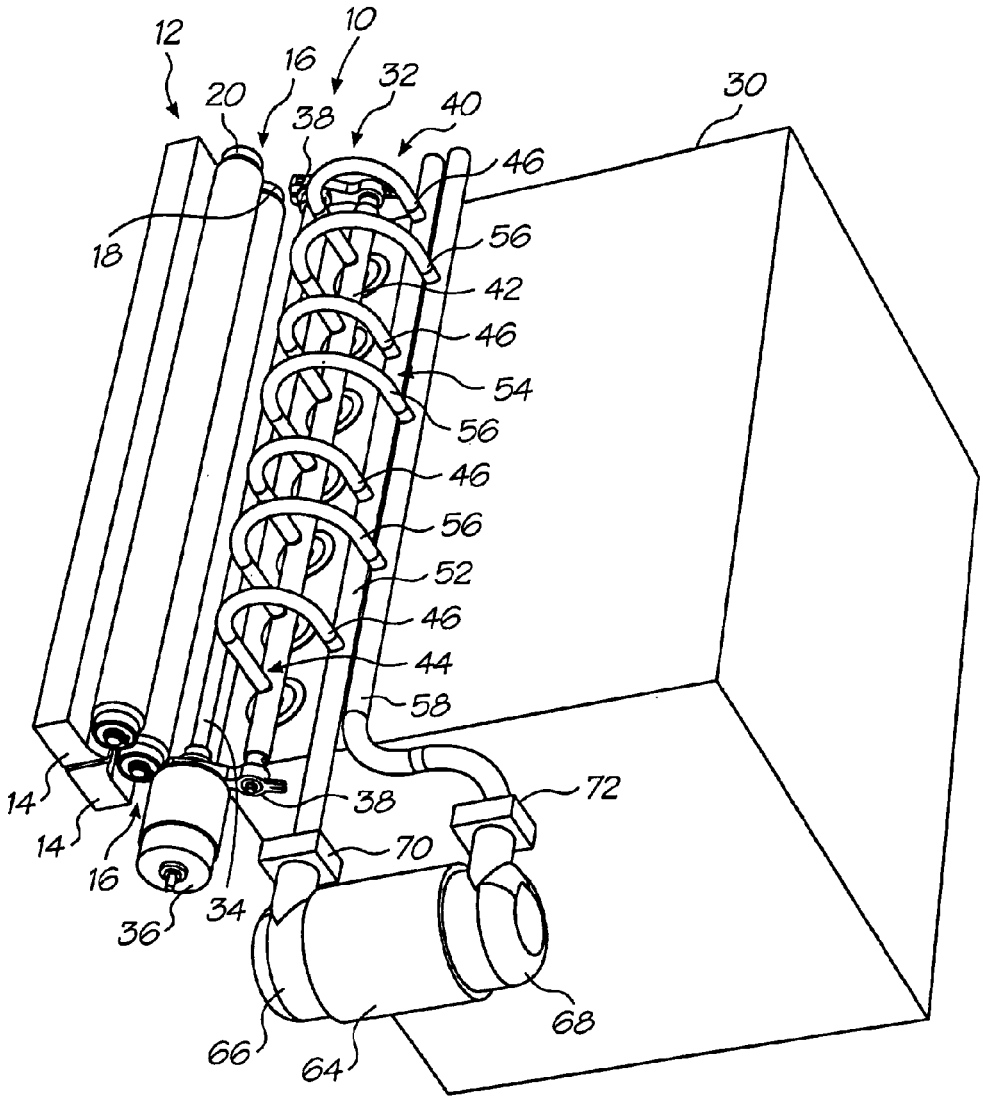
FIG. 1 shows a part of a printer including a print media feed arrangement, the print media feed arrangement including an apparatus, in accordance with the invention, for separating a sheet of print media from a stack of sheets.
Figure 2:
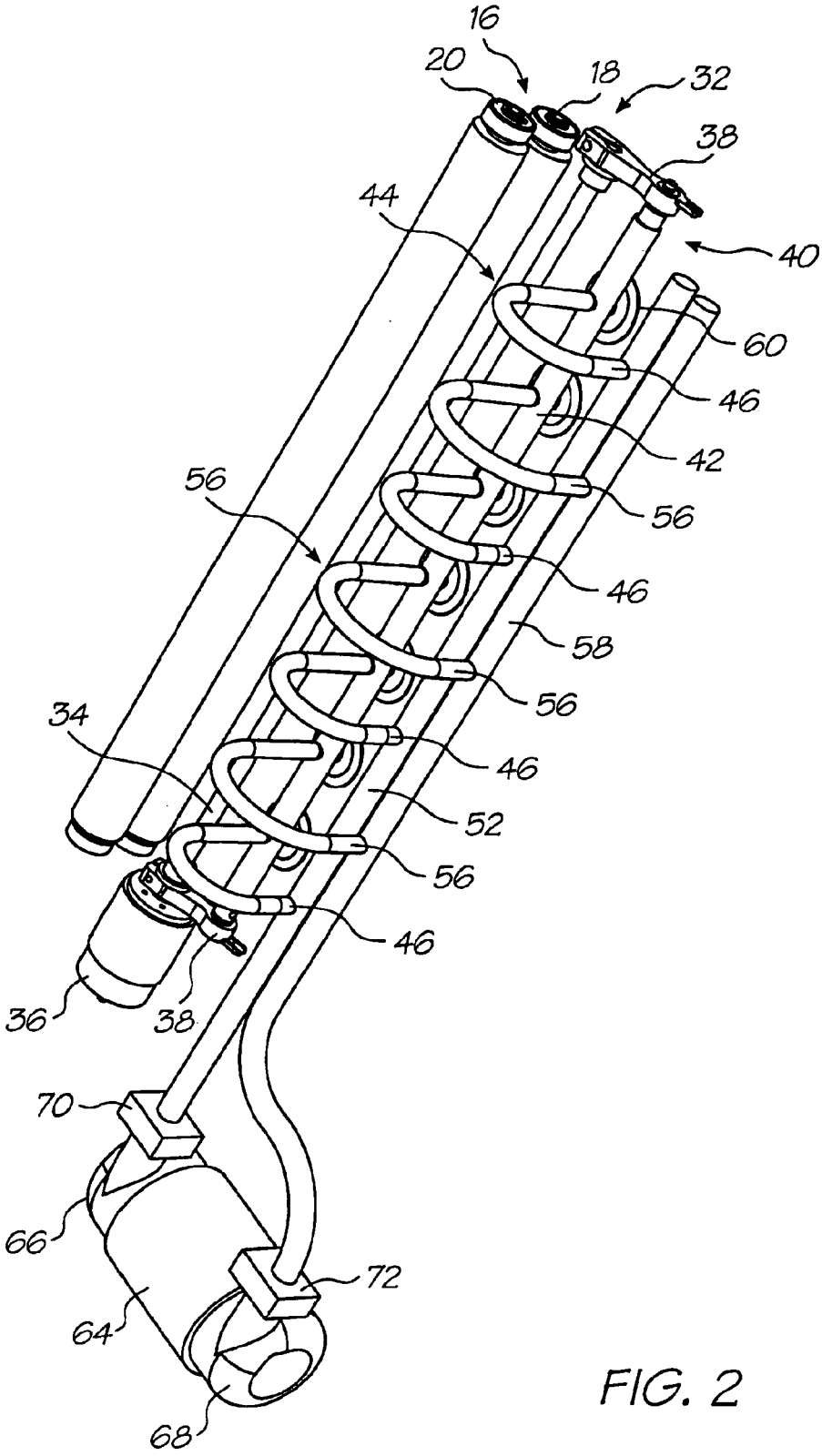
FIG. 2 shows a three-dimensional view of the print media feed arrangement, including the apparatus of the invention.

Referring to FIG. 1 of the drawings, a part of a printer is illustrated and is designated generally by the reference numeral 10. The printer 10 is a high-speed printer which prints both sides of print media at the rate of approximately one to two sheets per second or two to four pages per second (i.e. both sides of the sheet). The print media is, in this case, in the form of a stack of sheets. For ease of explanation, the invention will be described with reference to the print media being a stack of A4 sheets of paper and, more particularly, sheets of paper having a predetermined degree of porosity.

The printer 10, to affect the high speed printing, has a printing station 12 comprising a pair of opposed printheads 14. Each printhead 14 is in the form of a microelectromechanical systems (MEMS) chip having an array of ink jet nozzles to achieve the high speed, photographic quality printing desired. The nozzles are arranged in a close packed array to provide a resolution of up to 1600 dots per inch (dpi) to facilitate the photographic quality printing.

The printing station 12 includes a set of primary rollers 16 having a drive roller 18 and a driven roller 20. The set of primary rollers 16 is arranged upstream of the printheads 14 of the printing station 12 to convey a sheet of paper to the printheads 14.

The print media is, as described above, arranged in a stack 30. The stack 30 is received in a bin (not shown) of the printer 10 and is retained against a metal bulkhead of the printer 10 in a suitable cabinet (also not shown).

The printer 10 includes an apparatus 32, in accordance with the invention, forming part of a paper feed arrangement for feeding a sheet of paper from the stack 30 to the rollers 18 and 20 of the set of primary rollers 16 so that the sheet of paper can be transported to the printing station 12 for printing. The paper feed arrangement comprises a pivot rod or axle 34 which is rotatably driven by a stepper motor 36. A swing arm 38 is arranged at each end of the axle 34.

The apparatus 32 includes a picker assembly 40. The picker assembly 40 comprises an elongate element or pick up bar 42. The pick up bar 42 is rotatably supported between the swing arms 38 proximate free ends of the swing arms 38.

Accordingly, as the swing arms 34 pivot about a rotational axis of the axle 34, the pick up bar 42 is caused to be rotated about the rotational axis of the axle 34.

The apparatus 32 includes a separating means 44 carried on the pick up bar 42. The separating means 44 separates a topmost sheet 30.1 of paper from the stack 30. The separating means 44 includes a fluid delivery means in the form of a plurality of fluid supply conduits 46 arranged at spaced intervals along the length of the bar 42. Each conduit 46 is in the form of a flexible hose.

Figure 3:
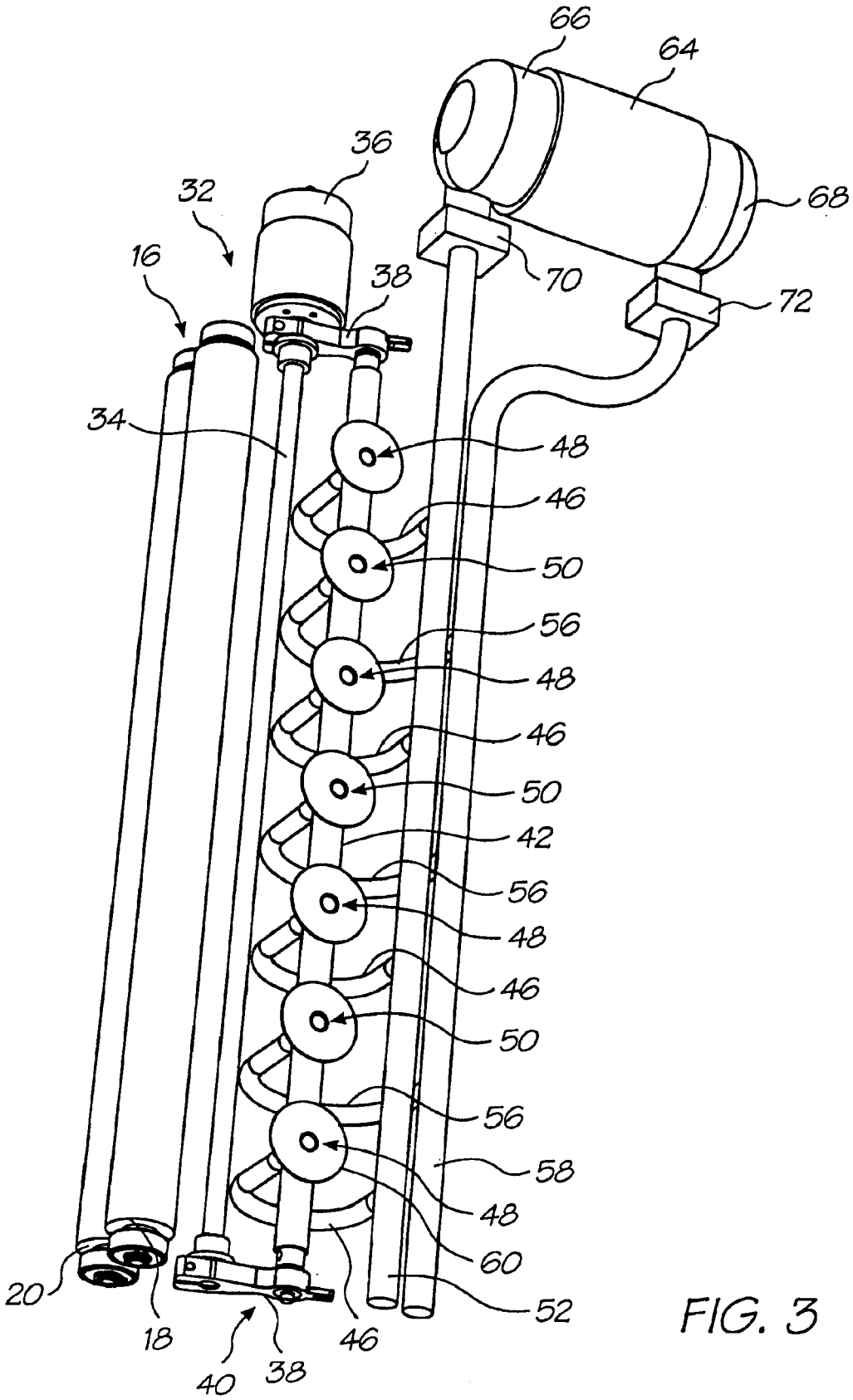
FIG. 3 shows a three-dimensional view, from below, of the print media feed arrangement.

As shown more clearly in FIG. 3 of the drawings, the pick up bar 42 has a plurality of alternating fluid ports 48, 50. An outlet end of each fluid conduit 46 opens out into one of the fluid ports 48 of the bar 42. An opposed, inlet end of each conduit 46 is connected to a fluid supply manifold 52.

The apparatus 32 further includes a capturing means 54, carried by the pick up bar 42, for capturing at least a part of the topmost sheet 30.1, after the sheet 30.1 has been separated from the stack 30, for facilitating conveyance of the topmost sheet 30.1 by the pick up bar 42 to the printing station 12, as will be described in greater detail below.

The capturing means 54 comprises a plurality of fluid suction conduits 56 which are arranged in alternating relationship with the fluid supply conduits 46 of the separating means 44. The fluid suction conduits 56, which are also in the form of flexible hoses, each have an inlet end in communication with one of the fluid ports 50 of the pick up bar 42. An outlet end of each conduit 56 feeds into a fluid extraction manifold 58.

Figure 4:
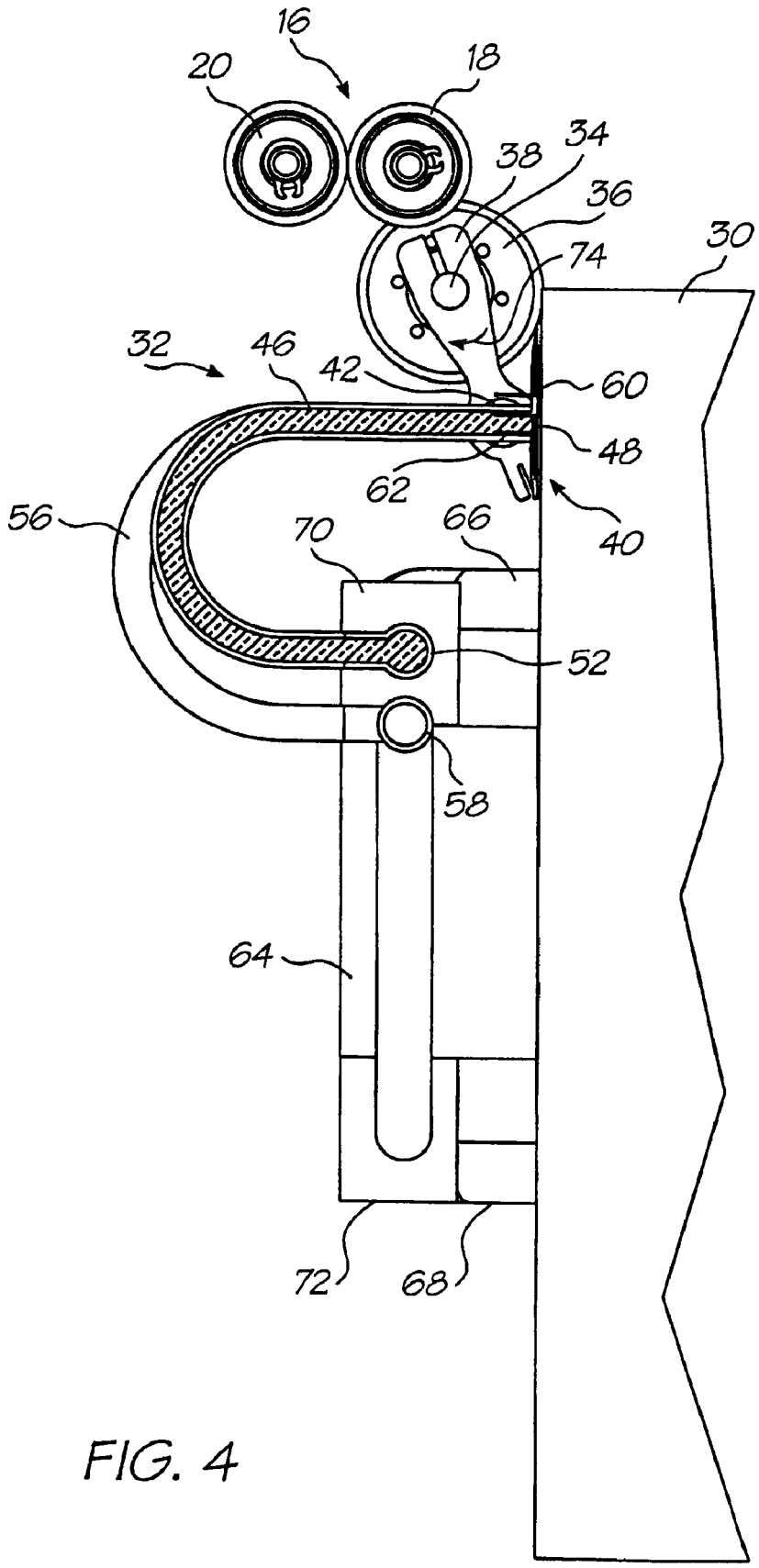
FIG. 4 shows a schematic, sectional side view of an initial stage of operation of the apparatus of the print media feed arrangement.

The picker assembly 40 further includes a plurality of displacement assistance means or pads 60 surrounding each fluid port 48, 50. Each pad 60 has a stalk portion 62 (FIG. 4) which projects into the bar 42 and is connected to an outlet end of one of the fluid supply conduits 46 or the inlet end of one of the fluid suction conduits 56, as the case may be. Instead, each displacement assistance means may be an elastomeric cup. Each cup is mounted via an urging means, in the form of a spring, on the pick up bar 42 to cater for a surface of the stack 30 having ripples or the like.

The apparatus 32 includes a drive means in the form of a drive motor 64 (FIG. 1). An air pump 66 is arranged on an output shaft at one end of the motor 64 and an extraction pump 68 is arranged on an output shaft at an opposed end of the motor 64. The air pump 66 communicates with the fluid supply manifold 52 via a solenoid-operated valve 70 arranged at an inlet end of the manifold 52. The extraction pump 68 communicates with an outlet end of the extraction manifold 58 via a further solenoid-operated valve 72.

As described above, the printer 10 is a high-speed printer which has a capacity to print at the rate of one sheet per second. To make use of this capability, it is important that the sheets of paper are fed individually to the printing station 12 from the stack 30 in an accurate, controlled manner. Consequently, it is necessary for the apparatus 32 to separate a sheet to be transported to the printing station 12 from the stack 30 accurately.

Further, the invention is intended particularly for use with print media which is porous such as, for example, 80-gsm paper.

In use, to separate the topmost sheet 30.1 from the stack 30, the pick up bar 42 is brought into close proximity to a top surface of the sheet but is held such that the pads 60 are spaced from the top surface of the topmost sheet 30.1 by a small amount, for example, 0.1 to 0.2 mm. The valve 70 is opened and the valve 72 is closed. The drive motor 64 is operated to cause air to be blown through the fluid supply manifold 52 into each of the fluid supply conduits 46. Air exhausts through the ports 48 and is blown on to the top surface of the topmost sheet 30.1. Due to the porosity of the paper, the air is also driven through the topmost sheet 30.1 and impinges on a sheet of the stack which is second from the top. This results in an initial separation of the topmost sheet 30.1 from the remainder of the sheets of the stack 30.

Also, as a result of localised low pressure occurring between a lower surface of each pad 60 and the topmost sheet 30.1 of the stack 30, the topmost sheet 30.1 is attracted at least to those pads 60 of the picker assembly 40 associated with the fluid supply conduits 46. Due to the passage of air through the topmost sheet 30.1, separation of the topmost sheet 30.1 from the remainder of the sheets of the stack 30 is aided.

Figure 5:
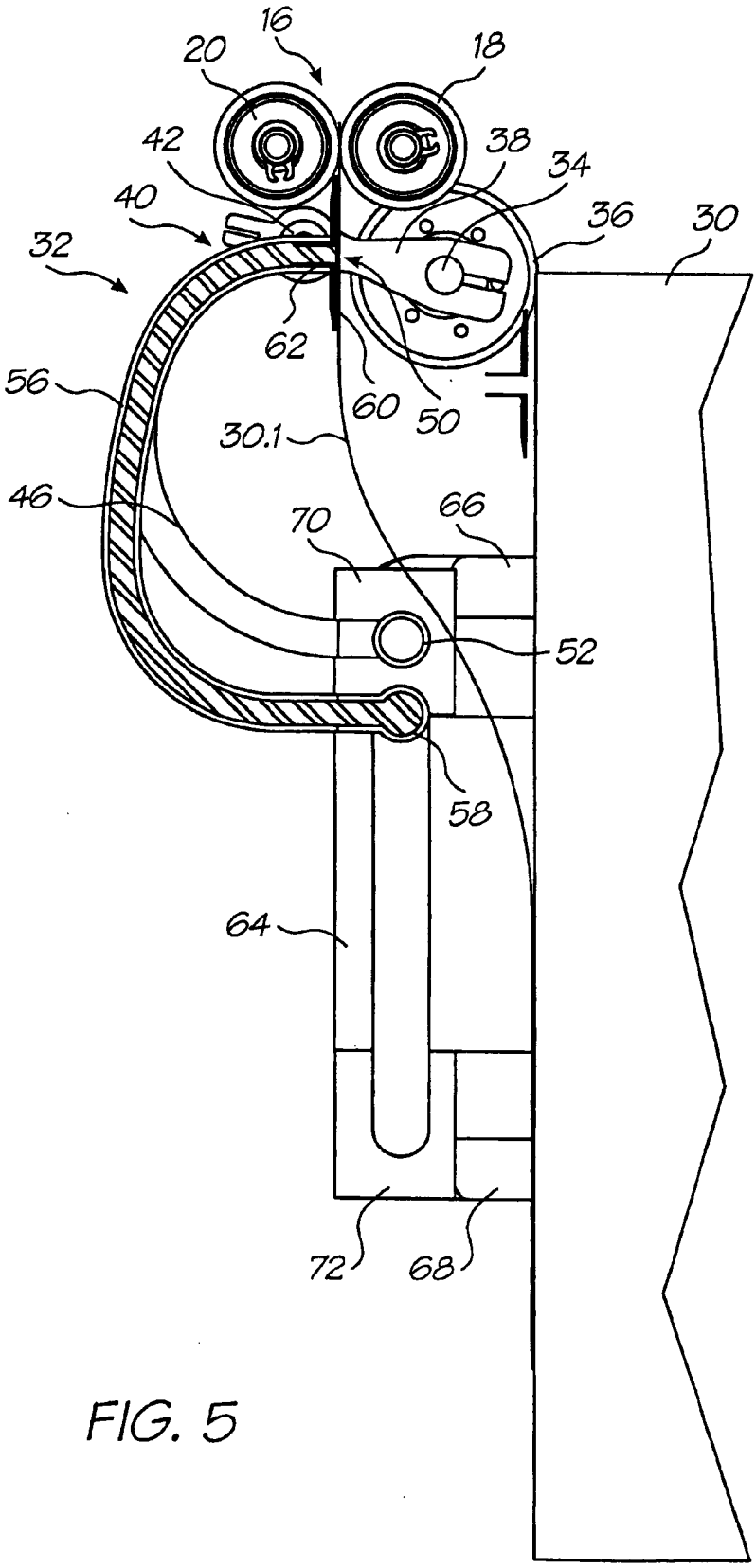
FIG. 5 shows a schematic, sectional side view of a further stage of operation of the apparatus of the print media feed arrangement.

When the topmost sheet 30.1 lifts from the sheet immediately below it in the stack 30, a leading edge of the topmost sheet 30.1 rises. When this occurs, the valve 70 closes and the valve 72 opens. Opening of the valve 72 causes air to be drawn in through the ports 50 of the pick up bar 42, through the fluid suction conduits 56 and out through the fluid extraction manifold 58. As a result of this, the leading edge of the topmost sheet 30.1 is sucked against at least those pads 60 associated with the fluid suction conduits 56 as shown in FIG. 5 of the drawings and is held captive against those pads 60. While this is occurring, the pick up bar 42 has been rotating about the axles 34 in the direction of arrow 74. The picker assembly 40 continues to rotate in the direction of arrow 74 until a leading edge of the topmost sheet 30.1 is fed between the rollers 18 and 20 of the set of rollers 16. The valve 72 is closed to release the suction on the topmost sheet 30.1 enabling the rollers 18, 20 of the set of rollers 16 to feed the sheet 30.1 to the printheads 14 of the printing station 12. As soon as a trailing edge of the sheet 30.1 clears the pads 60 of the assembly 40, the picker assembly 40 returns to its position shown in FIG. 4 of the drawings in readiness to feed the following sheet to the printing station 12.

It will be appreciated that air flow parallel to a surface of the topmost sheet 30.1 of the stack 30 results in a low friction cushion which facilitates translational motion of the sheet 30.1 relative to the pick up bar 42. This allows the sheet 30.1 to be moved by any suitable method in a direction normal to a face of the pick up bar 42 without hindering the picking action of the pick up bar 42. It also facilitates maintaining a trailing portion of the sheet 30.1 in spaced relationship relative to the stack 30 while the sheet 30.1 is being fed to the set of rollers 16.

The applicant has found that the velocity of air through the fluid supply conduits 46 in the initial, "blowing" direction is not critical, nor is the spacing between the pick up bar 42 and the topmost sheet 30.1 of the stack 30. Further, the weight or grade of the paper of the stack is also not critical provided that the paper in the stack has a degree of porosity. Typically, a pressure of approximately 5 kPa is present in the fluid supply conduits 46 when the air is blown on to the paper stack 30. The air is delivered at approximately 1 l/s and exits the gap between the pads 60 and the topmost sheet 30.1 at a pressure of approximately 1 kPa and at a velocity of approximately 50 m/s. The apparatus 32 has been found to operate with paper of a grade from 40 gsm to high resolution, photo-quality ink jet paper.

The applicant has found that, surprisingly, by blowing air on to the paper of the stack 30 separation of the sheets is facilitated. This is an entirely counter-intuitive approach, as one would expect that a suction-type mechanism would operate better. However, provided that the paper of the stack 30 has a degree of porosity, very good separation of the topmost sheet of paper from the stack 30 can be effected.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A device for lifting a porous sheet from a stack of such sheets, the device comprising a gas stream supply mechanism that is configured to generate a gas stream and is positioned so that, in use, the gas stream impinges on a first sheet of the stack, the gas stream supply mechanism being configured so that the gas stream penetrates the first sheet to generate a cushion of gas between the first sheet and a second sheet, thereby lifting the first sheet from the second sheet; and a capturing mechanism for capturing the first sheet.

2. A device as claimed in claim 1, in which the capturing mechanism is displaceable between a pick-up position in which the first sheet is captured and a feed position in which the first sheet can be engaged by a feed mechanism, the device including a displacement mechanism for displacing the capturing mechanism between the pick-up and feed positions.

3. A device as claimed in claim 2, in which the gas stream supply mechanism includes an air displacement device having an outlet conduit and at least one outlet nozzle connected to the outlet conduit, the, or each, outlet nozzle being displaceable between a pick-up position proximate the first sheet of the stack and a feed position, the air displacement device being configured to generate a flow of air from the, or each, outlet nozzle sufficient to penetrate the first sheet such that a cushion of air is generated between the first sheet and a second sheet to lift the first sheet from the second sheet.

4. A device as claimed in claim 3, in which the capturing mechanism includes an air extraction device having an inlet conduit, at least one inlet nozzle connected to the inlet conduit, the, or each, inlet nozzle defining a pick-up surface and being displaceable between the pick-up position proximate the first sheet of the stack and a feed position, the air extraction device being configured to generate a flow of air into the, or each, inlet nozzle such that the first sheet is drawn against the pick-up surface.

5. A device as claimed in claim 4, which includes a plurality of outlet nozzles that are positioned to span the first sheet, a plurality of inlet nozzles, also positioned to span the first sheet, an outlet manifold that interconnects the outlet conduit of the air displacement device and the outlet nozzles and an inlet manifold that interconnects the inlet conduit of the air extraction device and the inlet nozzles.

6. A device as claimed in claim 5, in which the inlet and outlet nozzles are generally aligned and are in alternating positions with respect to each other.

7. A device as claimed in claim 5, in which the air displacement mechanism is an air pump and the air extraction device is an evacuation pump, both pumps being connected to a shaft of a drive motor so that, when operated, the air pump serves to supply air to the outlet conduit and to draw air into the inlet conduit substantially simultaneously.

8. A device as claimed in claim 5, in which a flexible hose interconnects each nozzle with its respective manifold, thereby facilitating displacement of the nozzles with respect to their respective manifolds.

9. A device as claimed in claim 5, in which the displacement mechanism is a reciprocal drive mechanism for driving the inlet and outlet nozzles reciprocally between the pick-up position and the feed position.

10. A device as claimed in claim 9, in which the nozzles are connected to an elongate carrier, which, in turn, is connected to the reciprocal drive mechanism so that the elongate carrier and thus the nozzles can be displaced reciprocally between the pick-up and feed positions.

11. A device as claimed in claim 10, in which the elongate carrier is a bar and the drive mechanism includes a stepper motor connected to an axle that extends substantially parallel to the bar, a swing arm being interposed between each end of the axle and a corresponding end of the bar so that reciprocal movement generated by the stepper motor can be transmitted to the bar and thus the nozzles.

12. A device as claimed in claim 5, in which each nozzle has a sheet-engaging member that, in respect of the inlet nozzles, defines the pick-up surfaces and, in respect of the outlet nozzles is such that as air is expelled from the outlet nozzles, a region of low pressure is generated intermediate the outlet nozzle and the first sheet, thereby facilitating lifting of the first sheet.

* * * * *